US009905190B2

(12) United States Patent
Lin et al.

(10) Patent No.: US 9,905,190 B2
(45) Date of Patent: Feb. 27, 2018

(54) DRIVING CIRCUIT APPLIED TO LCD APPARATUS

(71) Applicant: Raydium Semiconductor Corporation, Hsinchu (TW)

(72) Inventors: Yi Chieh Lin, Tainan (TW); Jun-Ren Shih, Hsinchu (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 36 days.

(21) Appl. No.: 15/238,759

(22) Filed: Aug. 17, 2016

(65) Prior Publication Data

US 2017/0076681 A1 Mar. 16, 2017

(30) Foreign Application Priority Data

Sep. 15, 2015 (TW) ..... 104130470 A

(51) Int. Cl.
*G09G 3/36* (2006.01)

(52) U.S. Cl.
CPC ..... *G09G 3/3696* (2013.01); *G09G 3/3688* (2013.01); *G09G 2310/027* (2013.01); *G09G 2330/021* (2013.01)

(58) Field of Classification Search
CPC ..... G09G 2310/027; G09G 3/3688; G09G 2310/0289; G09G 3/3648; G09G 3/3696; G09G 2310/0291
USPC ..... 345/89, 98, 99, 100
See application file for complete search history.

(56) References Cited

U.S. PATENT DOCUMENTS

2003/0006979 A1* 1/2003 Tsuchi ..... G09G 3/3688 345/204
2008/0204439 A1* 8/2008 Morita ..... G09G 3/3688 345/209
2013/0127806 A1* 5/2013 Wu ..... G09G 3/3688 345/211
2013/0127930 A1* 5/2013 Nishio ..... G09G 3/3688 345/690

* cited by examiner

*Primary Examiner* — Koosha Sharifi-Tafreshi

(57) ABSTRACT

A driving circuit applied to a LCD apparatus is disclosed. The driving circuit includes a channel data line, a reference voltage generation unit, an external storage capacitor, a comparing unit, a switching unit, and an operation unit. The channel data line transmits a data. The reference voltage generation unit generates a reference voltage. A terminal of the external storage capacitor is coupled to ground. The comparing unit compares the reference voltage and a capacitor voltage and outputs a compared result. The switching unit is coupled to another terminal of the external storage capacitor and the channel data line. The operation unit is coupled to the comparing unit, the channel data line, and the switching unit to receive the compared result and a MSB of the data to operate, and to selectively switch on the switching unit.

14 Claims, 3 Drawing Sheets

DRIVING CIRCUIT APPLIED TO LCD APPARATUS

BACKGROUND OF THE INVENTION

1. Field of the Invention

This invention relates to a display apparatus, especially to a driving circuit applied to a LCD apparatus.

2. Description of the Prior Art

Please refer to FIG. 1. FIG. 1 illustrates a schematic diagram of the conventional driving circuit applied to the LCD apparatus. As shown in FIG. 1, the driving circuit 1 includes a first channel CH1 and a second channel CH2. Wherein, the first channel CH1 includes latching units 10A and 11A, a level shifting unit 12A, a digital-analog converting unit 13A and an operational amplifying unit 14A; the second channel CH2 includes latching units 10B and 11B, a level shifting unit 12B, a digital-analog converting unit 13B and an operational amplifying unit 14B. The input terminals of the latching units 10A and 10B are coupled to two output terminals of the shifting register SR respectively.

The transistor SW1 is coupled between the output terminal of the operational amplifying unit 14A and a positive voltage (3V). The gate of the transistor SW1 is coupled to the switches PSW1 and PSW2 respectively, wherein the switch PSW1 is coupled to another positive voltage (6V) and the switch PSW2 is coupled between the digital-analog converting unit 13A and the operational amplifying unit 14A. When the digital-analog converting unit 13A inputs an input voltage higher than the positive voltage 3V into the operational amplifying unit 14A, the switch PSW1 will be switched on and the switch PSW2 will be switched off. Otherwise, the switch PSW2 will be switched on and the switch PSW1 will be switched off.

Similarly, the transistor SW2 is coupled between the output terminal of the operational amplifying unit 14B and a negative voltage (−3V). The gate of the transistor SW2 is coupled to the switches PSW3 and PSW4 respectively, wherein the switch PSW3 is coupled to another negative voltage (−6V) and the switch PSW4 is coupled between the digital-analog converting unit 13B and the operational amplifying unit 14B. When the digital-analog converting unit 13B inputs an input voltage higher than the positive voltage 3V into the operational amplifying unit 14B, the switch PSW3 will be switched on and the switch PSW4 will be switched off. Otherwise, the switch PSW4 will be switched on and the switch PSW3 will be switched off.

Compared with the ordinary amplifier OP driving data by driving the voltage source having AVDD level or NAVDD level all the time to charge to a target voltage level, the power saving mechanism of this driving circuit structure is to drive the voltage source having VCI level or NVCI level to pre-charge to a specific voltage level at first and then drive the voltage source having AVDD level or NAVDD level to continuously charge to the target voltage level.

By doing so, if AVDD=2*VCI and NAVDD=2*NVCI, there will be about half of the power consumption can be saved before driving the voltage source having AVDD level or NAVDD level to charge.

However, the above-mentioned driving circuit structure has the following drawbacks:

(1) When the value of the data becomes zero, the charges stored in the data line capacitor will not be collected.

(2) Using the most significant bit (MSB) of the data and pre-charging to the VCI level or NVCI level may cause over-charging and more power consumption.

SUMMARY OF THE INVENTION

Therefore, the invention provides a driving circuit applied to a LCD apparatus to solve the above-mentioned problems.

An embodiment of the invention is a driving circuit. In this embodiment, the driving circuit is applied to a LCD apparatus. The driving circuit includes a first channel data line, a first reference voltage generation unit, a first external storage capacitor, a first comparing unit, a first switching unit and a first operation unit. The first channel data line is configured to transmit a first data. The first reference voltage generation unit is configured to generate a first reference voltage. A terminal of the first external storage capacitor is coupled to a ground terminal. Two input terminals of the first comparing unit are coupled to the first reference voltage generation unit and another terminal of the first external storage capacitor respectively to receive the first reference voltage and a first capacitor voltage respectively and an output terminal of the first comparing unit outputs a first comparing result. The first switching unit is coupled to the another terminal of the first external storage capacitor and the first channel data line respectively. first operation unit coupled to the output terminal of the first comparing unit, the first channel data line and the first switching unit respectively, wherein the first operation unit generates a first operational result according to the first comparing result and a most significant bit (MSB) of the first data and then selectively switches on the first switching unit according to the first operational result.

In an embodiment, the first reference voltage generation unit includes a plurality of resistors coupled in series between a first voltage and a second voltage to provide the first reference voltage.

In an embodiment, the first voltage is higher than the second voltage and the first reference voltage is a positive voltage.

In an embodiment, the first data transmitted by the first channel data line has a positive voltage.

In an embodiment, the driving circuit includes a first determining unit coupled to the first channel data line, wherein the first determining unit is configured to determine whether a first level of the first data is a high voltage level or a low voltage level.

In an embodiment, when the first data is discharged from the first level to a zero level, if the first determining unit determines that the first level of the first data is the high voltage level and the first comparing result is that the first capacitor voltage is lower than the first reference voltage, then the first operation unit switches on the first switching unit to make charges on the first channel data line to be stored in the first external storage capacitor; if the first determining unit determines that the first level of the first data is the low voltage level, then the first operation unit switches off the first switching unit to prevent the charges stored in the first external storage capacitor from flowing back to the first channel data line.

In an embodiment, when the first data is charged from a zero level to a first setting level, if the first determining unit determines that the first level of the first data is the high voltage level and the first comparing result is that the first capacitor voltage is higher than the first reference voltage, then the first operation unit switches on the first switching unit to make the first channel data line be pre-charged by charges stored in the first external storage capacitor; if the first determining unit determines that the first level of the first data is the low voltage level, then the first operation unit switches off the first switching unit to prevent the first channel data line from being over-charged.

In an embodiment, the driving circuit includes a second channel data line, a second reference voltage generation unit, a second external storage capacitor, a second comparing unit, a second switching unit and a second operation unit. The second channel data line is configured to transmit a second data. The second reference voltage generation unit is configured to generate a second reference voltage. A terminal of the second external storage capacitor is coupled to a ground terminal. Two input terminals of the second comparing unit are coupled to the second reference voltage generation unit and another terminal of the second external storage capacitor respectively to receive the second reference voltage and a second capacitor voltage respectively and an output terminal of the second comparing unit outputs a second comparing result. The second switching unit is coupled to the another terminal of the second external storage capacitor and an output terminal of the second channel data line. The second operation unit is coupled to the output terminal of the second comparing unit, the second channel data line and the second switching unit respectively, wherein the second operation unit generates a second operational result according to the second comparing result and a most significant bit (MSB) of the second data and then selectively switches on the second switching unit according to the second operational result.

In an embodiment, the second reference voltage generation unit includes a plurality of resistors coupled in series between a third voltage and a fourth voltage to provide the second reference voltage.

In an embodiment, the third voltage is lower than the fourth voltage and the second reference voltage is a negative voltage.

In an embodiment, the second data transmitted by the second channel data line has a negative voltage.

In an embodiment, the driving circuit includes a second determining unit coupled to the second channel data line, wherein the second determining unit is configured to determine whether a second level of the second data is a high voltage level or a low voltage level.

In an embodiment, when the second data is charged from the second level to a zero level, if the second determining unit determines that the second level of the second data is the low voltage level and the second comparing result is that the second capacitor voltage is higher than the second reference voltage, then the second operation unit switches on the second switching unit to make the second channel data line be pre-charged by charges stored in the second external storage capacitor; if the second determining unit determines that the second level of the second data is the high voltage level, then the second operation unit switches off the second switching unit to prevent the second channel data line from being over-charged.

In an embodiment, when the second data is discharged from a zero level to a second setting level, if the second determining unit determines that the second level of the second data is the low voltage level and the second comparing result is that the second capacitor voltage is lower than the second reference voltage, then the second operation unit switches on the second switching unit to make charges on the second channel data line to be stored to the second external storage capacitor; if the second determining unit determines that the second level of the second data is the high voltage level, then the second operation unit switches off the second switching unit to prevent the charges stored in the second external storage capacitor from flowing back to the second channel data line.

Compared to the prior arts, the driving circuit applied to the LCD apparatus in the invention can collect the charges discharged from the data line capacitor on the panel and then use the collected charges to pre-charge to a specific voltage level when the data line capacitor is charged next time, and then continuously charged to the target voltage level through the operational amplifier to save the power consumption. In addition, the driving circuit applied to the LCD apparatus in the invention determines whether to switch on the switch on the pre-charging path or not based on the external capacitor voltage detection result of the comparator and the pre-charging source is a passive capacitor which can effectively prevent the data line capacitor from being over-charged.

The advantage and spirit of the invention may be understood by the following detailed descriptions together with the appended drawings.

BRIEF DESCRIPTION OF THE APPENDED DRAWINGS

Figure 1:
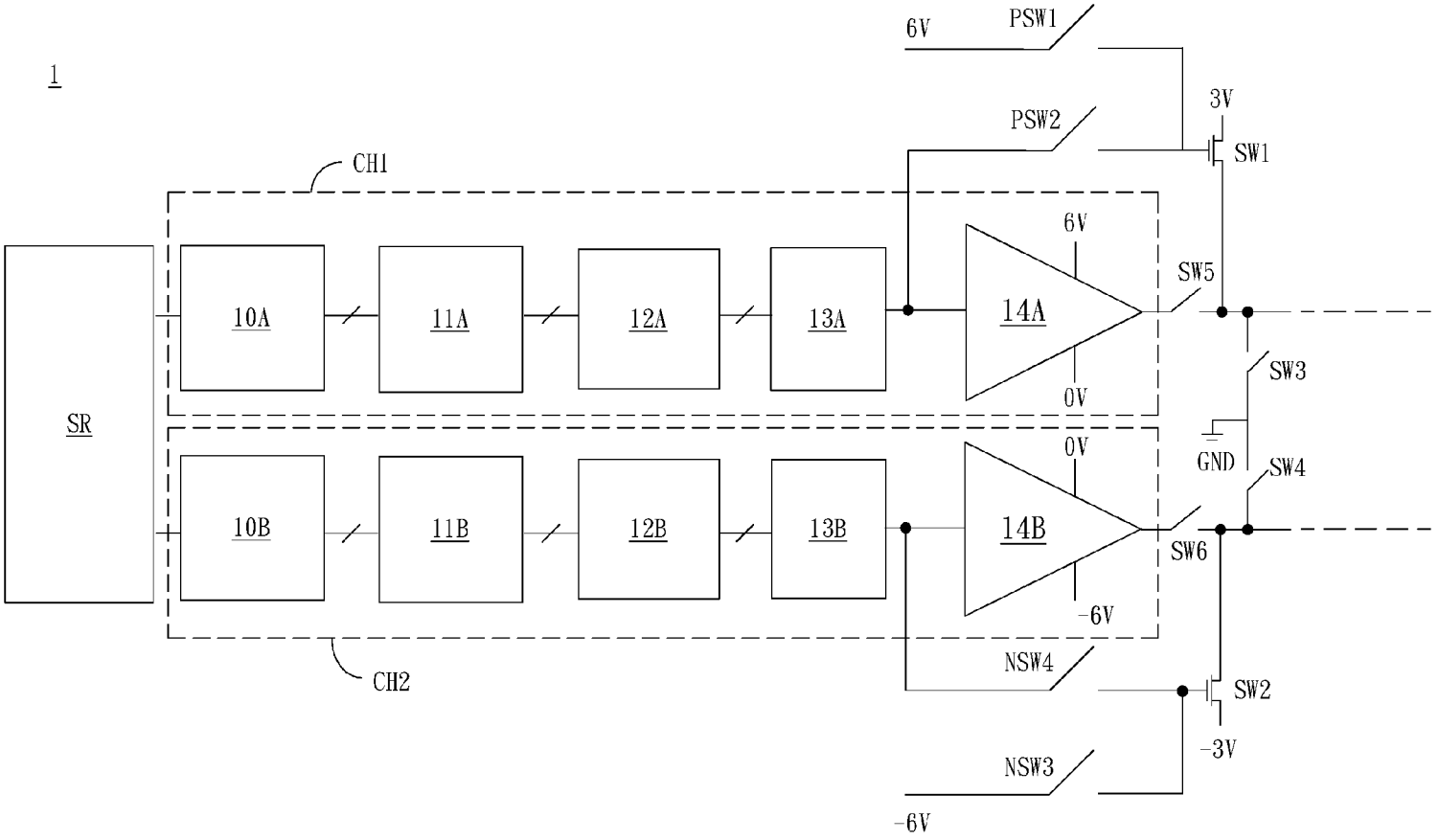
FIG. 1 (PRIOR ART)
FIG. 1 illustrates a schematic diagram of the conventional driving circuit applied to the LCD apparatus.
Figure 2:
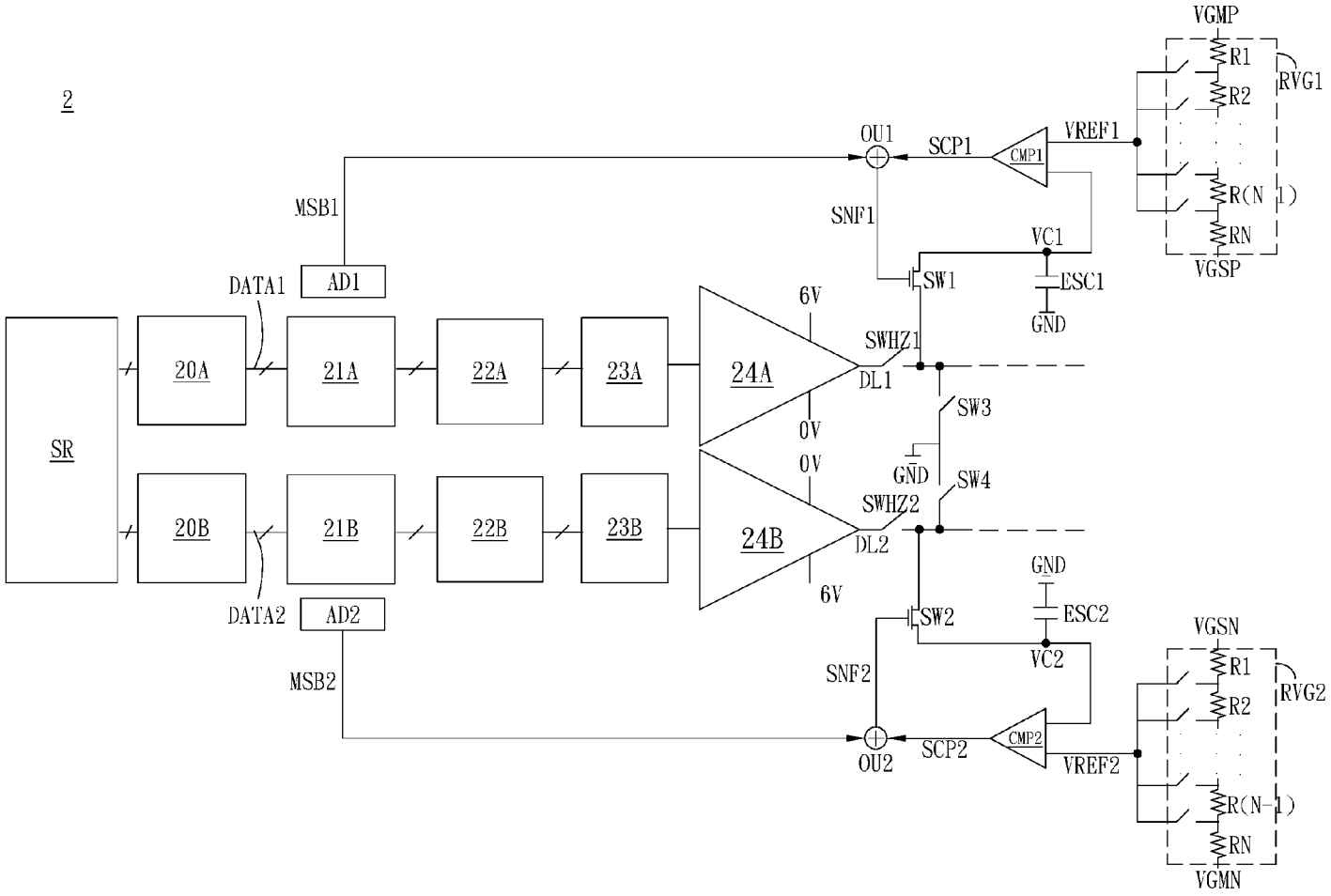
FIG. 2 illustrates a schematic diagram of the driving circuit applied to the LCD apparatus in a preferred embodiment of the invention.

FIG. 3A~FIG. 3E illustrate timing diagrams of the levels of the signals shown in FIG. 2.

DETAILED DESCRIPTION OF THE INVENTION

A preferred embodiment of the invention is a driving circuit. In this embodiment, the driving circuit is applied to a LCD apparatus.

Please refer to FIG. 2. FIG. 2 illustrates a schematic diagram of the driving circuit applied to the LCD apparatus in this embodiment.

As shown in FIG. 2, the driving circuit 2 can include a first channel CH1 and a second channel CH2. Wherein, the first channel CH1 includes latching units 20A and 21A, a level shifting unit 22A, a digital-analog converting unit 23A and an operational amplifying unit 24A. And, the latching units 20A and 21A, the level shifting unit 22A, the digital-analog converting unit 23A and the operational amplifying unit 24A are coupled in series in order through a first channel data line DL1; the second channel CH2 includes latching units 20B and 21B, a level shifting unit 22B, a digital-analog converting unit 23B and an operational amplifying unit 24B. And, the latching units 20B and 21B, the level shifting unit 22B, the digital-analog converting unit 23B and the operational amplifying unit 24B are coupled in series in order through a second channel data line DL2.

The input terminal of the latching unit 20A of the first channel CH1 and the input terminal of the latching unit 20B of the second channel CH2 are coupled to two output terminals of the shifting register SR respectively. Two switches SW3 and SW4 are coupled in series between the output terminal of the operational amplifying unit 24A of the first channel CH1 and the output terminal of the operational amplifying unit 24B of the second channel CH2; a node between the two switches SW3 and SW4 is coupled to the ground terminal GND.

It should be noticed that if the first channel CH1 is a positive voltage channel and the second channel CH2 is a negative voltage channel, then the first data DATA1 transmitted by the first channel data line DL1 has positive voltage and the second data DATA2 transmitted by the second channel data line DL2 has negative voltage. The level shifting unit 22A, the digital-analog converting unit 23A and the operational amplifying unit 24A can be a P-type level shifter, a P-type level digital-analog converter and a P-type operational amplifier respectively; the level shifting unit 22B, the digital-analog converting unit 23B and the operational amplifying unit 24B can be a N-type level shifter, a N-type level digital-analog converter and a N-type operational amplifier respectively.

In this embodiment, the driving circuit 2 also includes a first reference voltage generation unit RVG1, a first external storage capacitor ESC1, a first comparing unit CMP1, a first switching unit SW1, a first operation unit OU1 and a first determining unit AD1. The first channel data line DL1 is used to transmit a first data DATA1. The first reference voltage generation unit RVG1 is used to generate a first reference voltage VREF1. A terminal of the first external storage capacitor ESC1 is coupled to the ground terminal GND.

Two input terminals of the first comparing unit CMP1 are coupled to the first reference voltage generation unit RVG1 and another terminal of the first external storage capacitor ESC1 respectively and receive a first reference voltage VREF1 and a first capacitor voltage VC1 respectively and output a first comparison result SCP1 through the output terminal of the first comparing unit CMP1.

The first switching unit SW1 is coupled to another terminal of the first external storage capacitor ESC1, the output terminal of the operational amplifying unit 24A and the output terminal of the first operation unit OU1. In practical applications, the first switching unit SW1 is a P-type transistor, but not limited to this. In addition, a switch SWHZ1 can be disposed between the first switching unit SW1 and the output terminal of the first operation unit OU1.

The first determining unit AD1 is coupled to the latching unit 21A to determine whether the first voltage level of the first data DATA1 stored in the latching unit 21A is a high voltage level or a low voltage level.

The first operation unit OU1 is coupled to the output terminal of the first comparing unit CMP1, the first determining unit AD1 and the gate of the first switching unit SW1. The first operation unit OU1 receives the first comparison result SCP1 and the most significant bit MSB1 of the first data DATA1 respectively and generates a first operational result according to the first comparison result SCP1 and the most significant bit MSB1 of the first data DATA1 and then selectively outputs a first switch control signal SNF1 to the first switching unit SW1 to switch on the first switching unit SW1 according to the first operational result.

Similarly, the driving circuit 2 also includes a second reference voltage generation unit RVG2, a second external storage capacitor ESC2, a second comparing unit CMP2, a second switching unit SW2, a second operation unit OU2 and a second determining unit AD2. The second channel data line DL2 is used to transmit a second data DATA2. The second reference voltage generation unit RVG2 is used to generate a second reference voltage VREF2. A terminal of the second external storage capacitor ESC2 is coupled to the ground terminal GND.

Two input terminals of the second comparing unit CMP2 are coupled to the second reference voltage generation unit RVG2 and another terminal of the second external storage capacitor ESC2 respectively and receive a second reference voltage VREF2 and a second capacitor voltage VC2 respectively and output a second comparison result SCP2 through the output terminal of the second comparing unit CMP2.

The second switching unit SW2 is coupled to another terminal of the second external storage capacitor ESC2, the output terminal of the operational amplifying unit 24B and the output terminal of the second operation unit OU2. In practical applications, the second switching unit SW2 is an N-type transistor, but not limited to this. In addition, a switch SWHZ2 can be disposed between the second switching unit SW2 and the output terminal of the second operation unit OU2.

The second determining unit AD2 is coupled to the latching unit 21B to determine whether the second voltage level of the second data DATA2 stored in the latching unit 21B is a high voltage level or a low voltage level.

The second operation unit OU2 is coupled to the output terminal of the second comparing unit CMP2, the second determining unit AD2 and the gate of the second switching unit SW2. The second operation unit OU2 receives the second comparison result SCP2 and the most significant bit MSB2 of the second data DATA2 respectively and generates a second operational result according to the second comparison result SCP2 and the most significant bit MSB2 of the second data DATA2 and then selectively outputs a second switch control signal SNF2 to the second switching unit SW2 to switch on the second switching unit SW2 according to the second operational result.

In an embodiment, the first reference voltage generation unit RVG1 can include N resistors R1~RN, and the N resistors R1~RN are coupled in series between the first voltage VGMP and the second voltage VGSP to provide the first reference voltage VREF1. Wherein, the first voltage VGMP is higher than the second voltage VGSP, and the first reference voltage VREF1 is a positive voltage, and N is a positive integer.

At first, how to store data line charges through the storing capacitor in the discharging process will be introduced as follows.

When the first data DATA1 is discharged from the first level to a zero level, the first determining unit AD1 will determine whether the first level of the first data DATA1 is the high voltage level or the low voltage level. If the first determining unit AD1 determines that the first level of the first data DATA1 is the high voltage level and the first comparing result SCP1 of the first comparing unit CMP1 is that the first capacitor voltage VC1 is lower than the first reference voltage VREF1, then the first operation unit OU1 will switch on the first switching unit SW1 to make charges on the first channel data line DL1 to be stored in the first external storage capacitor ESC1; if the first determining unit AD1 determines that the first level of the first data DATA1 is the low voltage level, then the first operation unit OU1 will switch off the first switching unit SW1 to prevent the charges stored in the first external storage capacitor ESC1 from flowing back to the first channel data line DL1.

From above, it can be found that in the discharging process, only when the first level is a high voltage level and the first capacitor voltage VC1 is lower than the first reference voltage VREF1, the first switching unit SW1 can be switched on, so that the charges on the first channel data line DL1 can be smoothly stored in the first external storage capacitor ESC1 without the condition that the charges flowing back to the first channel data line DL1.

Then, the condition that the data line is pre-charged by the data line charge stored in the storing capacitor during the charging process will be introduced as follows.

When the first data DATA1 is charged from a zero level to a first setting level, the first determining unit AD1 will determine that the first level of the first data DATA1 is the high voltage level or the low voltage level. If the first determining unit AD1 determines that the first level of the first data DATA1 is the high voltage level and the first comparing result SCP1 of the first comparing unit CMP1 is that the first capacitor voltage VC1 is higher than the first reference voltage VREF1, then the first operation unit OU1 will switch on the first switching unit SW1 to make the first channel data line DL1 be pre-charged by the charges stored in the first external storage capacitor ESC1; if the first determining unit AD1 determines that the first level of the first data DATA1 is the low voltage level, then the first operation unit OU1 will switch off the first switching unit SW1 to prevent the first channel data line DL1 from being over-charged.

From above, it can be found that during the charging process, the first switching unit SW1 will be switched on only when the first level of the first data DATA1 is the high voltage level and the first capacitor voltage VC1 is higher than the first reference voltage VREF1, so that the first channel data line DL1 can be smoothly pre-charged by the charges stored by the first external storage capacitor ESC1 and the first channel data line DL1 can be prevented from being over-charged.

Similarly, the second reference voltage generation unit RVG2 can include N resistors R1~RN, and the N resistors R1~RN are coupled in series between the third voltage VGSN and the fourth voltage VGMN to provide the second reference voltage VREF2. Wherein, the third voltage VGSN is lower than the fourth voltage VGMN, and the second reference voltage VREF2 is a negative voltage.

When the second data DATA2 is charged from the second level to a zero level, if the second determining unit AD2 determines that the second level of the second data is the low voltage level and the second comparing result SCP2 of the second comparing unit CMP2 is that the second capacitor voltage VC2 is higher than the second reference voltage VREF2, then the second operation unit OU2 will switch on the second switching unit SW2 to make the second channel data line DL2 be pre-charged by the charges stored in the second external storage capacitor ESC2; if the second determining unit AD2 determines that the second level of the second data DATA2 is the high voltage level, then the second operation unit OU2 will switch off the second switching unit SW2 to prevent the second channel data line DL2 from being over-charged.

When the second data DATA2 is discharged from a zero level to a second setting level, if the second determining unit AD2 determines that the second level of the second data is the low voltage level and the second comparing result SCP2 of the second comparing unit CMP2 is that the second capacitor voltage VC2 is lower than the second reference voltage VREF2, then the second operation unit OU2 will switch on the second switching unit SW2 to make the charges on the second channel data line DL2 to be stored to the second external storage capacitor ESC2; if the second determining unit AD2 determines that the second level of the second data DATA2 is the high voltage level, then the second operation unit OU2 will switch off the second switching unit SW2 to prevent the charges stored in the second external storage capacitor ESC2 from flowing back to the second channel data line DL2.

Figures 3A, 3B, 3C, 3D, 3E:
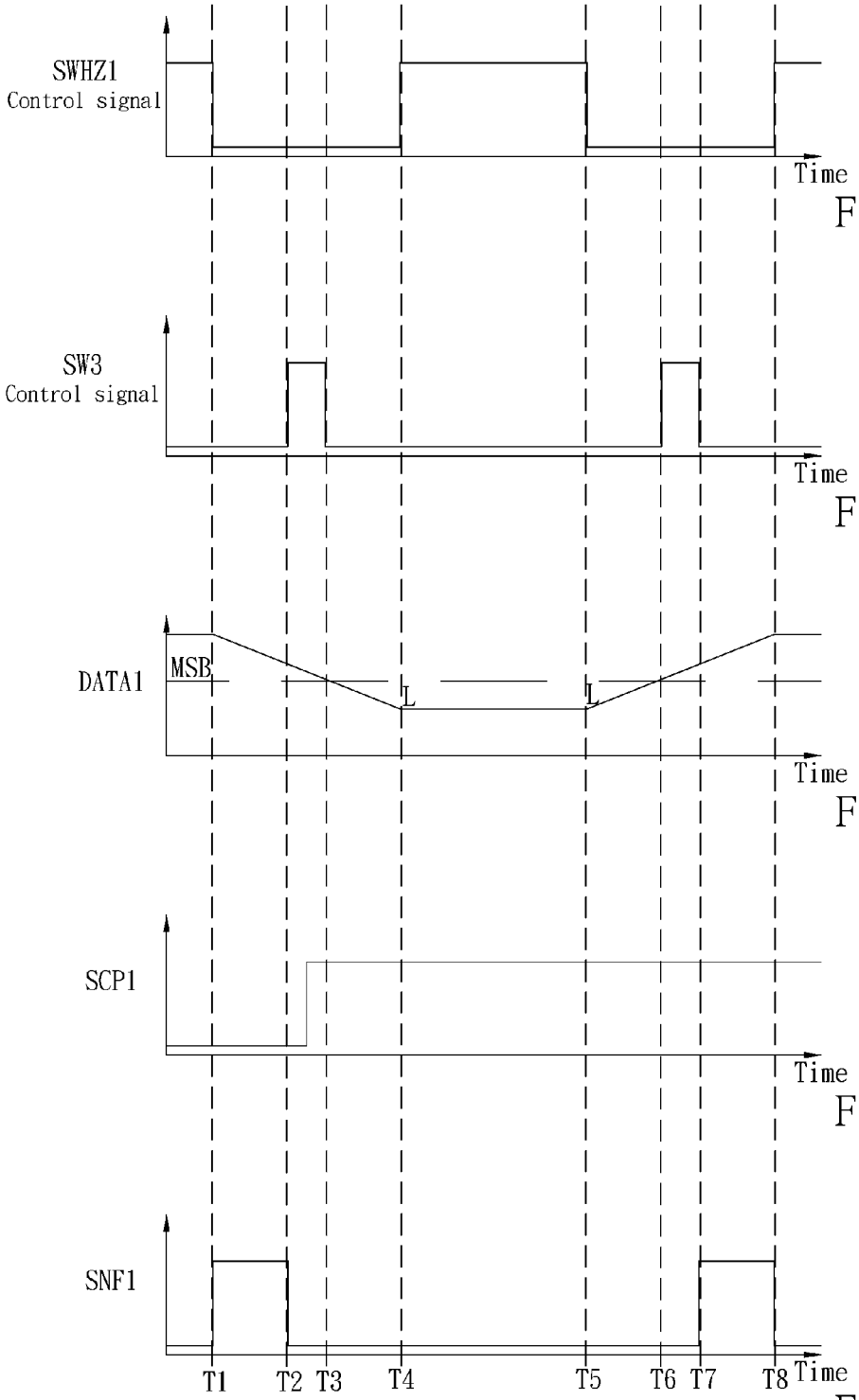

Then, please refer to FIG. 3A~FIG. 3E. FIG. 3A~FIG. 3E illustrate timing diagrams of the levels of the signals shown in FIG. 2. Wherein, FIG. 3A illustrates the timing diagram of the control signal of the switch SWHZ1; FIG. 3B illustrates the timing diagram of the control signal of the switch SW3; FIG. 3C illustrates the timing diagram of the first data DATA1; FIG. 3D illustrates the timing diagram of the first comparing result SCP1 of FIG. 2; FIG. 3E illustrates the timing diagram of the first switch control signal SNF1 of the first switching unit SW1 of FIG. 2.

At the time T1, the control signal of the switch SWHZ1 in FIG. 3A is changed from the high level to the low level, and it represents that the output terminal of the first operation unit OU1 and the first switching unit SW1 and the panel data lines are disconnected; the control signal of the switch SW3 in FIG. 3B is at the low level, it represents that the first switching unit SW1 and the panel data lines are not coupled to the ground terminal GND; the first data DATA1 in FIG. 3C has a target high level and ready to start the charging process; the first comparing result SCP1 in FIG. 3D is at the low level, it represents that the first comparing result SCP1 is that the first capacitor voltage VC1 is lower than the first reference voltage VREF1; since the first data DATA1 has the high level and the first capacitor voltage VC1 is lower than the first reference voltage VREF1, the first switch control signal SNF1 of the first switching unit SW1 in FIG. 3E will be changed from the low level to the high level, it represents that the first switching unit SW1 will be switched on and conducted at this time.

At the time T2, the control signal of the switch SWHZ1 in FIG. 3A is maintained the low level, and it represents that the output terminal of the first operation unit OU1 and the first switching unit SW1 and the panel data lines are maintained disconnected; the control signal of the switch SW3 in FIG. 3B is changed from the low level to the high level, it represents that the first switching unit SW1 and the panel data lines are coupled to the ground terminal GND; the level of the first data DATA1 in FIG. 3C is continuously decreased from the high level, it represents that the charges on the data line are discharged to the storage capacitor; the first comparing result SCP1 in FIG. 3D is maintained at the low level, it represents that the first comparing result SCP1 is still that the first capacitor voltage VC1 is lower than the first reference voltage VREF1; since the first data DATA1 no longer has the high level, the first switch control signal SNF1 of the first switching unit SW1 in FIG. 3E will be changed from the high level to the low level, it represents that the first switching unit SW1 will be switched off and not conducted at this time.

At the time T3, the control signal of the switch SWHZ1 in FIG. 3A is maintained the low level, and it represents that the output terminal of the first operation unit OU1 and the first switching unit SW1 and the panel data lines are maintained disconnected; the control signal of the switch SW3 in FIG. 3B is changed from the high level to the low level, it represents that the first switching unit SW1 and the panel data lines are not coupled to the ground terminal GND; the level of the first data DATA1 in FIG. 3C is continuously decreased toward the target low level, it represents that the discharging process will be ended soon and it will be changed to the charging process from the storage capacitor to the data line; the first comparing result SCP1 in FIG. 3D is changed from the low level to the high level, it represents that the first comparing result SCP1 is that the first capacitor voltage VC1 is higher than the first reference voltage VREF1; the first switch control signal SNF1 of the first switching unit SW1 in FIG. 3E is maintained the low level, it represents that the first switching unit SW1 is still switched off and not conducted at this time.

At the time T4, the control signal of the switch SWHZ1 in FIG. 3A is changed from the low level to the high level, and it represents that the output terminal of the first operation unit OU1 and the first switching unit SW1 and the panel data lines are electrically connected; the control signal of the switch SW3 in FIG. 3B is maintained the low level, it represents that the first switching unit SW1 and the panel data lines are not coupled to the ground terminal GND; the level of the first data DATA1 in FIG. 3C is decreased to the target low level; the first comparing result SCP1 in FIG. 3D is maintained the high level, it represents that the first comparing result SCP1 is that the first capacitor voltage VC1 is higher than the first reference voltage VREF1; the first switch control signal SNF1 of the first switching unit SW1 in FIG. 3E is maintained the low level, it represents that the first switching unit SW1 is still switched off and not conducted at this time.

At the time T5, the control signal of the switch SWHZ1 in FIG. 3A is changed from the high level to the low level, and it represents that the output terminal of the first operation unit OU1 and the first switching unit SW1 and the panel data lines are disconnected; the control signal of the switch SW3 in FIG. 3B is maintained the low level, it represents that the first switching unit SW1 and the panel data lines are not coupled to the ground terminal GND; the first data DATA1 having the target low level in FIG. 3C is ready to discharge; the first comparing result SCP1 in FIG. 3D is maintained the high level, it represents that the first comparing result SCP1 is that the first capacitor voltage VC1 is higher than the first reference voltage VREF1; the first switch control signal SNF1 of the first switching unit SW1 in FIG. 3E is maintained the low level, it represents that the first switching unit SW1 is still switched off and not conducted at this time.

At the time T6, the control signal of the switch SWHZ1 in FIG. 3A is maintained the low level, and it represents that the output terminal of the first operation unit OU1 and the first switching unit SW1 and the panel data lines are disconnected; the control signal of the switch SW3 in FIG. 3B is changed from the low level to the high level, it represents that the first switching unit SW1 and the panel data lines are coupled to the ground terminal GND; the first data DATA1 in FIG. 3C is continuously increased, and the data line is charged; the first comparing result SCP1 in FIG. 3D is maintained the high level, it represents that the first comparing result SCP1 is that the first capacitor voltage VC1 is higher than the first reference voltage VREF1; the first switch control signal SNF1 of the first switching unit SW1 in FIG. 3E is maintained the low level, it represents that the first switching unit SW1 is still switched off and not conducted at this time.

At the time T7, the control signal of the switch SWHZ1 in FIG. 3A is maintained the low level, and it represents that the output terminal of the first operation unit OU1 and the first switching unit SW1 and the panel data lines are disconnected; the control signal of the switch SW3 in FIG. 3B is changed from the high level to the low level, it represents that the first switching unit SW1 and the panel data lines are not coupled to the ground terminal GND; the first data DATA1 in FIG. 3C is continuously increased, and the data line is charged to the high level; the first comparing result SCP1 in FIG. 3D is maintained the high level, it represents that the first comparing result SCP1 is that the first capacitor voltage VC1 is higher than the first reference voltage VREF1; the first switch control signal SNF1 of the first switching unit SW1 in FIG. 3E is changed from the low level to the high level, it represents that the first switching unit SW1 is switched on and conducted at this time.

At the time T8, the control signal of the switch SWHZ1 in FIG. 3A is changed from the low level to the high level, and it represents that the output terminal of the first operation unit OU1 and the first switching unit SW1 and the panel data lines are electrically connected; the control signal of the switch SW3 in FIG. 3B is maintained the low level, it represents that the first switching unit SW1 and the panel data lines are not coupled to the ground terminal GND; the first data DATA1 in FIG. 3C has the target high level; the first comparing result SCP1 in FIG. 3D is maintained the high level, it represents that the first comparing result SCP1 is that the first capacitor voltage VC1 is higher than the first reference voltage VREF1; the first switch control signal SNF1 of the first switching unit SW1 in FIG. 3E is changed from the high level to the low level, it represents that the first switching unit SW1 is switched off and not conducted at this time.

Compared to the prior arts, the driving circuit applied to the LCD apparatus in the invention can collect the charges discharged from the data line capacitor on the panel and then use the collected charges to pre-charge to a specific voltage level when the data line capacitor is charged next time, and then continuously charged to the target voltage level through the operational amplifier to save the power consumption. In addition, the driving circuit applied to the LCD apparatus in the invention determines whether to switch on the switch on the pre-charging path or not based on the external capacitor voltage detection result of the comparator and the pre-charging source is a passive capacitor which can effectively prevent the data line capacitor from being over-charged.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A driving circuit applied to a LCD apparatus, the driving circuit comprising:

a first channel data line configured to transmit a first data;

a first reference voltage generation unit configured to generate a first reference voltage;

a first external storage capacitor, wherein a terminal of the first external storage capacitor is coupled to a ground terminal;

a first comparing unit, wherein two input terminals of the first comparing unit are coupled to the first reference voltage generation unit and another terminal of the first external storage capacitor respectively to receive the first reference voltage and a first capacitor voltage respectively and an output terminal of the first comparing unit outputs a first comparing result;

a first switching unit coupled to the another terminal of the first external storage capacitor and the first channel data line respectively; and a first operation unit coupled to the output terminal of the first comparing unit, the first channel data line and the first switching unit respectively, wherein the first operation unit generates a first operational result according to the first comparing result and a most significant bit (MSB) of the first data and then selectively switches on the first switching unit according to the first operational result.

2. The driving circuit of claim 1, wherein the first reference voltage generation unit comprises a plurality of resistors coupled in series between a first voltage and a second voltage to provide the first reference voltage.

3. The driving circuit of claim 2, wherein the first voltage is higher than the second voltage and the first reference voltage is a positive voltage.

4. The driving circuit of claim 1, wherein the first data transmitted by the first channel data line has a positive voltage.

5. The driving circuit of claim 1, further comprising:

a first determining unit coupled to the first channel data line, wherein the first determining unit is configured to determine whether a first level of the first data is a high voltage level or a low voltage level.

6. The driving circuit of claim 5, wherein when the first data is discharged from the first level to a zero level, if the first determining unit determines that the first level of the first data is the high voltage level and the first comparing result is that the first capacitor voltage is lower than the first reference voltage, then the first operation unit switches on the first switching unit to make charges on the first channel data line to be stored in the first external storage capacitor; if the first determining unit determines that the first level of the first data is the low voltage level, then the first operation unit switches off the first switching unit to prevent the charges stored in the first external storage capacitor from flowing back to the first channel data line.

7. The driving circuit of claim 5, wherein when the first data is charged from a zero level to a first setting level, if the first determining unit determines that the first level of the first data is the high voltage level and the first comparing result is that the first capacitor voltage is higher than the first reference voltage, then the first operation unit switches on the first switching unit to make the first channel data line be pre-charged by charges stored in the first external storage capacitor; if the first determining unit determines that the first level of the first data is the low voltage level, then the first operation unit switches off the first switching unit to prevent the first channel data line from being over-charged.

8. The driving circuit of claim 1, further comprising:

a second channel data line configured to transmit a second data;

a second reference voltage generation unit configured to generate a second reference voltage;

a second external storage capacitor, wherein a terminal of the second external storage capacitor is coupled to a ground terminal;

a second comparing unit, wherein two input terminals of the second comparing unit are coupled to the second reference voltage generation unit and another terminal of the second external storage capacitor respectively to receive the second reference voltage and a second capacitor voltage respectively and an output terminal of the second comparing unit outputs a second comparing result;

a second switching unit coupled to the another terminal of the second external storage capacitor and an output terminal of the second channel data line; and a second operation unit coupled to the output terminal of the second comparing unit, the second channel data line and the second switching unit respectively, wherein the second operation unit generates a second operational result according to the second comparing result and a most significant bit (MSB) of the second data and then selectively switches on the second switching unit according to the second operational result.

9. The driving circuit of claim 8, wherein the second reference voltage generation unit comprises a plurality of resistors coupled in series between a third voltage and a fourth voltage to provide the second reference voltage.

10. The driving circuit of claim 9, wherein the third voltage is lower than the fourth voltage and the second reference voltage is a negative voltage.

11. The driving circuit of claim 8, wherein the second data transmitted by the second channel data line has a negative voltage.

12. The driving circuit of claim 8, further comprising:

a second determining unit coupled to the second channel data line, wherein the second determining unit is configured to determine whether a second level of the second data is a high voltage level or a low voltage level.

13. The driving circuit of claim 12, wherein when the second data is charged from the second level to a zero level, if the second determining unit determines that the second level of the second data is the low voltage level and the second comparing result is that the second capacitor voltage is higher than the second reference voltage, then the second operation unit switches on the second switching unit to make the second channel data line be pre-charged by charges stored in the second external storage capacitor; if the second determining unit determines that the second level of the second data is the high voltage level, then the second operation unit switches off the second switching unit to prevent the second channel data line from being over-charged.

14. The driving circuit of claim 12, wherein when the second data is discharged from a zero level to a second setting level, if the second determining unit determines that the second level of the second data is the low voltage level and the second comparing result is that the second capacitor voltage is lower than the second reference voltage, then the second operation unit switches on the second switching unit to make charges on the second channel data line to be stored to the second external storage capacitor; if the second determining unit determines that the second level of the second data is the high voltage level, then the second operation unit switches off the second switching unit to prevent the charges stored in the second external storage capacitor from flowing back to the second channel data line.

* * * * *